US006997628B2

(12) United States Patent
Tu

(10) Patent No.: US 6,997,628 B2
(45) Date of Patent: Feb. 14, 2006

(54) METHOD AND DEVICE FOR EASILY INSTALLING A PRINTER CARTRIDGE

(75) Inventor: Chun-Ying Tu, Taipei (TW)

(73) Assignee: Hi-Touch Imaging Technologies Co., Ltd., Pan-Chiao (TW)

( * ) Notice: Subject to any disclaimer, the term of this patent is extended or adjusted under 35 U.S.C. 154(b) by 21 days.

(21) Appl. No.: 10/710,059

(22) Filed: Jun. 16, 2004

(65) Prior Publication Data

US 2005/0281602 A1 Dec. 22, 2005

(51) Int. Cl.
*B41J 17/24* (2006.01)
*B41J 29/00* (2006.01)

(52) U.S. Cl. ..... 400/208; 400/693

(58) Field of Classification Search ..... None
See application file for complete search history.

(56) References Cited

U.S. PATENT DOCUMENTS 4,632,585 A * 12/1986 Oyamatsu et al. ..... 400/613
4,754,290 A * 6/1988 Kitayama et al. ..... 347/222
5,243,360 A * 9/1993 Tomoda et al. ..... 347/214
5,741,080 A * 4/1998 Tomoda et al. ..... 400/208
6,604,876 B2 * 8/2003 Bryant et al. ..... 400/208

FOREIGN PATENT DOCUMENTS

JP 60245574 A * 12/1985
JP 61053072 A * 3/1986

* cited by examiner

*Primary Examiner*—Daniel J. Colilla
(74) *Attorney, Agent, or Firm*—Winston Hsu

(57) ABSTRACT

An easy-load mechanism and its associated method for installing a printer cartridge comprises a moveable cartridge bay for holding the printer cartridge, a lever device for accepting an external force, and a linking device the external force from the lever device to the moveable cartridge bay, wherein when the lever device is able to move the movable cartridge from an initial position to a target position via the linking device. Additionally, an alternative easy-load mechanism and its associated method for installing a printer cartridge comprises a moveable cartridge bay for holding the printer cartridge, a lever device for accepting an external force, a first engagement device, a second engagement device, and a third engagement device for transferring force from the lever device to the moveable cartridge bay, wherein the lever device is able to move the movable cartridge from an initial position to a target position via the engagement devices.

18 Claims, 12 Drawing Sheets

METHOD AND DEVICE FOR EASILY INSTALLING A PRINTER CARTRIDGE

BACKGROUND OF INVENTION

1. Field of the Invention

The invention relates to the installation of a printer cartridge, and more particularly, to a method and device for easily installing a printer cartridge in a dye diffusion thermal transfer printer.

2. Description of the Prior Art

A ubiquitous technology these days is the printer. As technology has progressed, so too has the printer. From the humble beginnings of the dot matrix printer, there are now inkjet printers and laser printers as well. One of the latest types of printers now is the dye diffusion thermal transfer printer. The dye diffusion thermal transfer printer was created specifically to print high quality photos from digital pictures.

A common aspect of dye diffusion thermal transfer printers is that some parts inside the printer become very hot during the printing process. This can pose a danger to users. The parts that become very hot are positioned close to where the printer cartridge is installed. As a result, if the user needs to change the print cartridge during or soon after the printing process, the user could suffer a burn while installing a new print cartridge, especially if the position of the print cartridge requires some adjustment when inside the printer. Therefore, how to easily and safely install the print cartridge becomes an important issue.

SUMMARY OF INVENTION

It is therefore one of the many objectives of the claimed invention to provide a method and a device for easily installing a printer cartridge in a printer to solve the above-mentioned problem.

According to the claimed invention, an easy-load mechanism of a printer for installing a printer cartridge is disclosed. The easy-load mechanism of a printer for installing a printer cartridge comprises a moveable cartridge bay for holding the printer cartridge, a lever device coupled to the moveable cartridge bay for accepting an external force exerted upon the lever device, and a linking device coupled to the lever device and the moveable cartridge bay for transferring the external force from the lever device to the moveable cartridge bay, wherein when the lever device is moved from a first initial position to an intermediate position, the linking device transferring the external force is capable of moving the movable cartridge bay from a second initial position to a second target position, and after the movable cartridge bay reaches the second target position, the linking device transferring the external force stops moving the movable cartridge bay, and the linking device allows the lever device to move from the intermediate position to a first target position.

In addition, a method for installing a printer cartridge into a printer is disclosed. The method comprises providing a moveable cartridge bay for holding the printer cartridge, providing a lever device for accepting an external force exerted upon the lever device, providing a linking device for transferring the external force from the lever device to the moveable cartridge bay, moving the lever device from a first initial position to an intermediate position through the external force and utilizing the linking device to transfer the external force for moving the movable cartridge bay from a second initial position to a second target position, and after the movable cartridge bay reaches the first target position, stopping the linking device from using the external force to move the movable cartridge bay and allowing the external force to move the lever device from the intermediate position to a first target position.

Furthermore, another easy-load mechanism of a printer for installing a printer cartridge is disclosed. This alternate easy-load mechanism of a printer for installing a printer cartridge comprises a moveable cartridge bay for holding the printer cartridge, a lever device coupled to the moveable cartridge bay for accepting an external force exerted upon the lever device, a first engagement device positioned on the lever device, wherein the first engagement device is moved if the lever device is moved, a second engagement device positioned on the moveable cartridge bay, and a third engagement device positioned between the first engagement device and the second engagement device for transferring force applied to the lever device to the moveable cartridge bay, wherein when the lever device driven by the external force is moved from a first initial position to an intermediate position, the first engagement device engages the third engagement device and the third engagement device in turn engages the second engagement device, all of which drives the second engagement device to move the movable cartridge bay from a second initial position to a second target position, and after the movable cartridge bay reaches the second target position, the first engagement device disengages from the third engagement device, thereby allowing the external force move the lever device from the intermediate position to a first target position.

Along with this alternate mechanism, a corresponding method for installing a printer cartridge into a printer comprising is also disclosed. The method for installing a printer cartridge into a printer comprises providing a moveable cartridge bay for holding the printer cartridge, providing a lever device for accepting an external force exerted upon the lever device, providing the lever device with a first engagement device which is moved if the lever device is moved, providing the moveable cartridge bay with a second engagement device, providing a third engagement device positioned between the first engagement device and the second engagement device for transferring force applied to the lever device to the moveable cartridge bay, when the lever device driven by the external force is moved from a first initial position to an intermediate position, utilizing the first engagement device to engage the third engagement device to drive the second engagement device for moving the movable cartridge bay from a second initial position to a second target position, and after the movable cartridge bay is located at the second target position, disengaging the first engagement device from the third engagement device and moving the lever device driven by the external force from the intermediate position to a first target position.

These and other objectives of the claimed invention will no doubt become obvious to those of ordinary skill in the art after reading the following detailed description of the preferred embodiment that is illustrated in the various figures and drawings.

DETAILED DESCRIPTION

Figure 1:
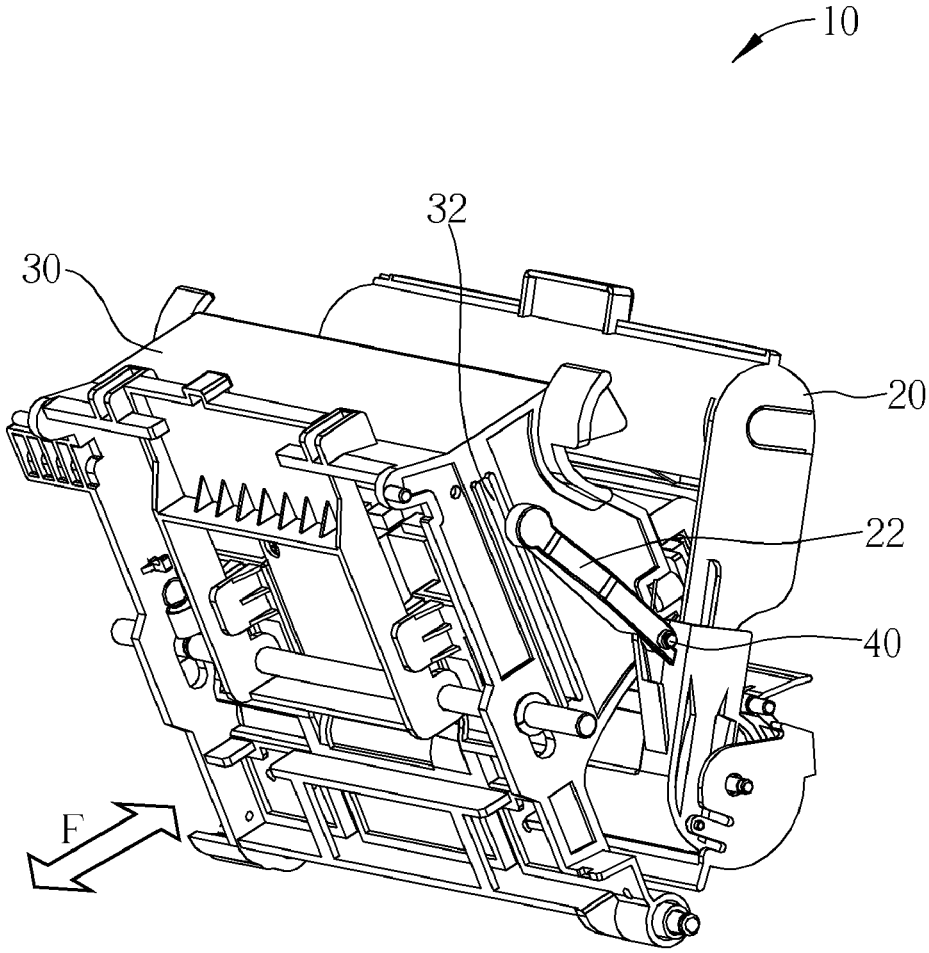
FIG. 1 is a perspective view of an easy-load mechanism according to the present invention.

Please refer to FIG. 1. FIG. 1 is a perspective view of an easy-load mechanism 10 according to the present invention. As one can see, the easy-load mechanism 10 comprises a moveable cartridge bay 20 for holding a printer cartridge (not shown), a lever device 30 coupled to the moveable cartridge bay 20 for accepting an external force F exerted upon the lever device 30, and a linking device 40 coupled to the lever device 30 and the moveable cartridge bay 20 for transferring the external force from the lever device 30 to the moveable cartridge bay 20.

Figure 2:
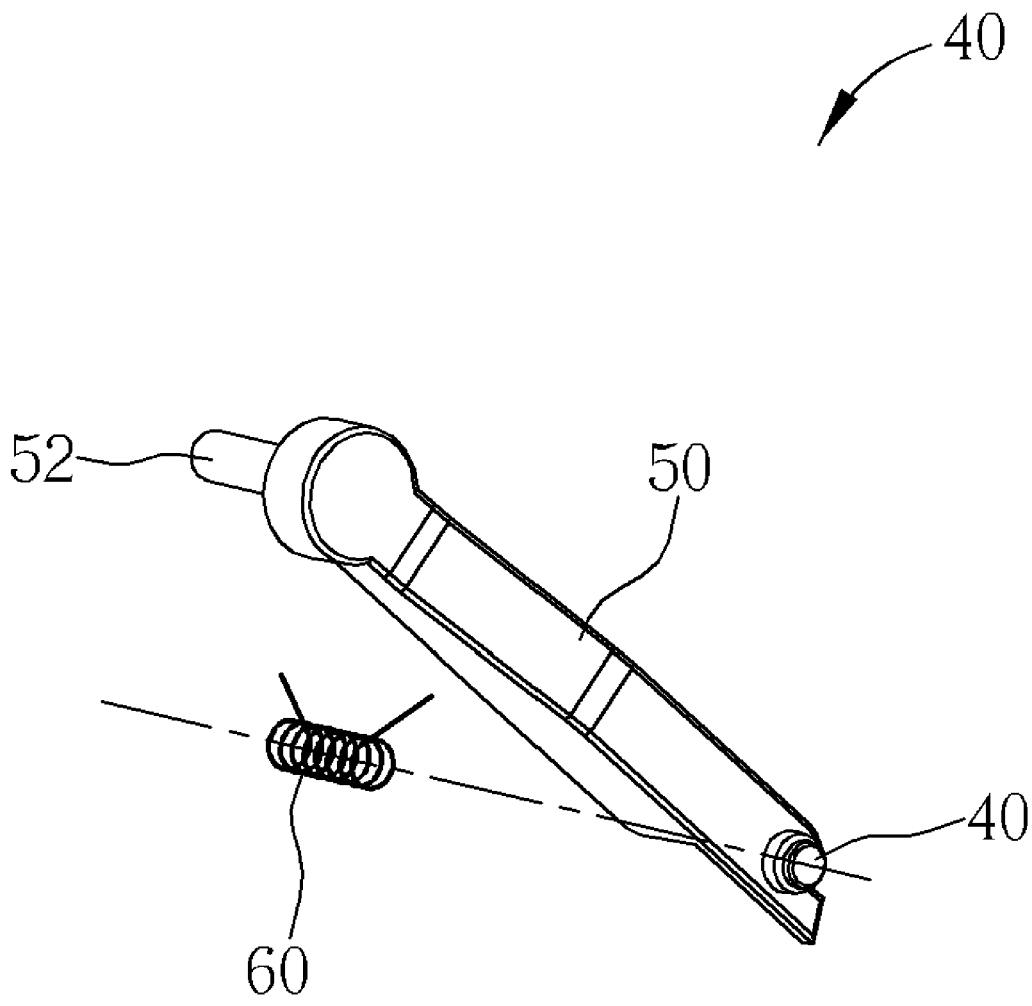
FIG. 2 is a perspective view illustrating a preferred embodiment of the linking device shown in FIG. 1.
Figure 3:
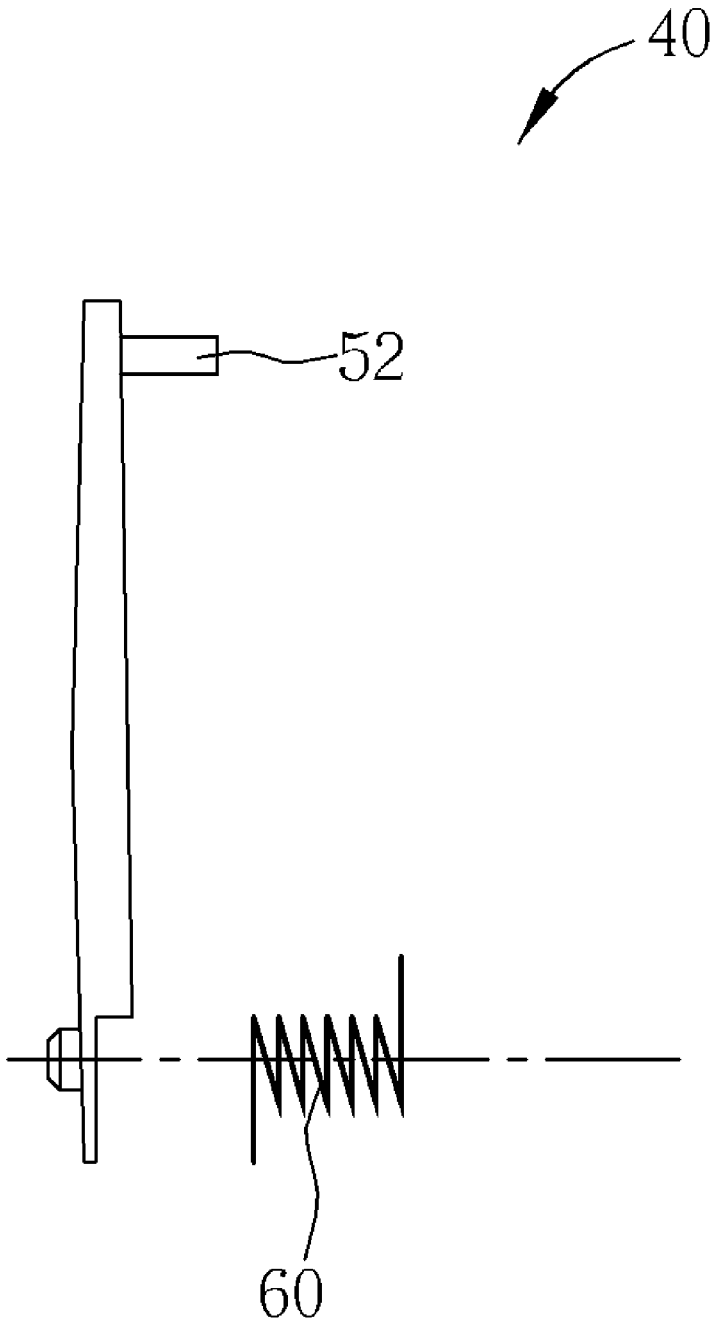
FIG. 3 is a top view of the linking device shown in FIG. 2.

Before moving on, please make note about the linking device 40 first. The linking device 40 of the present invention can be implemented in several ways. Please refer to FIG. 2 in conjunction with FIG. 3. FIG. 2 is a perspective view illustrating a preferred embodiment of the linking device 40 shown in FIG. 1, and FIG. 3 is a top view of the linking device 40 shown in FIG. 2. The linking device 40 comprises an arm 50 and an elastic unit 60, which is embodied by a spring 60. The linking device 40 is coupled to the lever device 30 via a protrusion 52 extending from one end of the arm 50. The protrusion 52 fits into a groove 32 (shown in FIG. 1) of the lever device 30, which the protrusion 52 can move up and down along. On the opposite end of the arm 50 is an opening 54; the opening 54 allows a protrusion 22 (shown in FIG. 1) from the moveable cartridge bay 20 to go through the arm 50, thus, coupling the arm 50 to the moveable cartridge bay 20. The spring 60 is aligned on the same axis as the opening 54 with one end of the spring 60 inserted into the arm 50 and the other end of the spring 60 inserted into the moveable cartridge bay 20. The spring 60, in this embodiment, is used to give an elastic force for separating the moveable cartridge bay 20 from the lever device 30 when deformed by the external force F. The operation is detailed in the following paragraphs.

Figure 4:
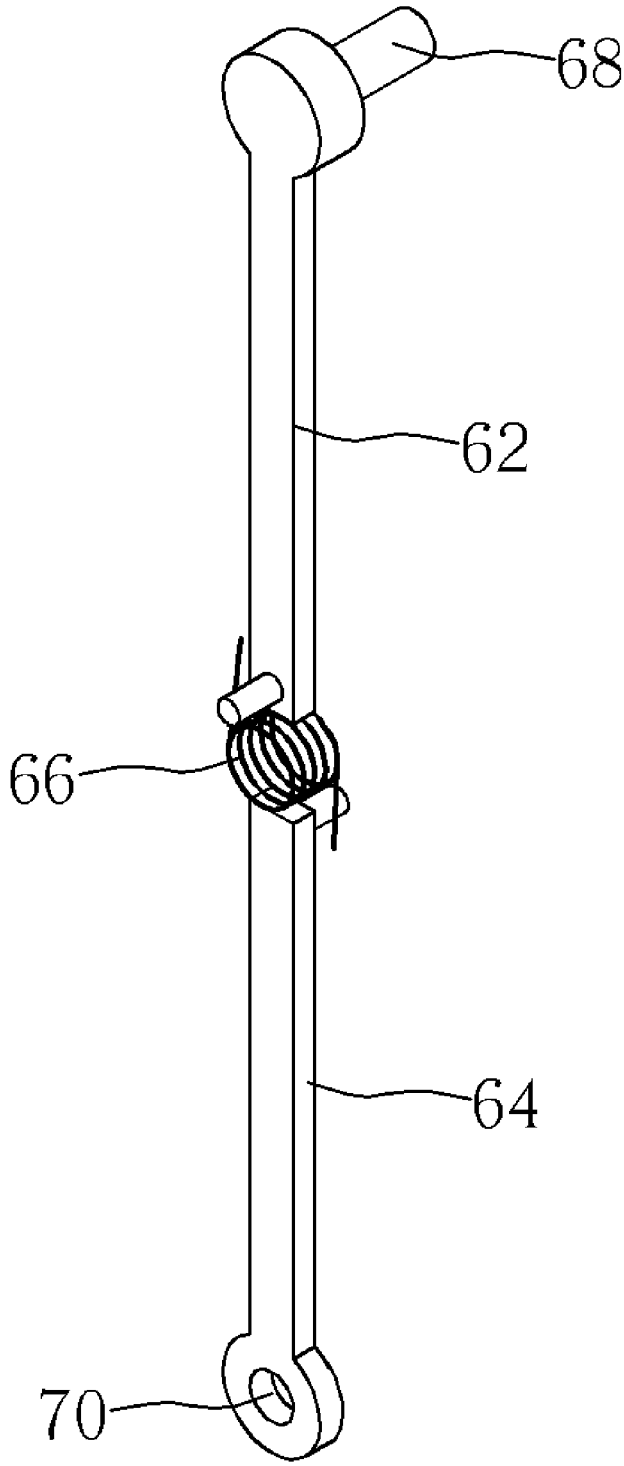
FIG. 4 is a diagram illustrating an alternate embodiment of the linking device possessing two arms.

Please note that the linking device 40 is not limited to this above-mentioned embodiment. The spring 60 can be used to couple the arm 50 to the lever device 30 instead of the moveable cartridge bay 20. In other words, an alternate embodiment of the linking device 40 could have the elastic unit 60 coupled to the arm 50 and the lever device 30. Still yet, another embodiment of the linking device 40 could possess two arms. Please refer to FIG. 4, which is a diagram illustrating an alternate embodiment of the linking device 40 possessing two arms. The linking device 40 consists of two arms 62, 64 and a spring 66. One arm 62 is coupled to the moveable cartridge bay 20 through a protrusion 68, and the other arm 64 is coupled to the lever device 30 through an opening 70. The spring 66 is coupled to both arms 62, 64 for pushing or pulling the arm 64 when the arm 62 is moved.

Figure 5:
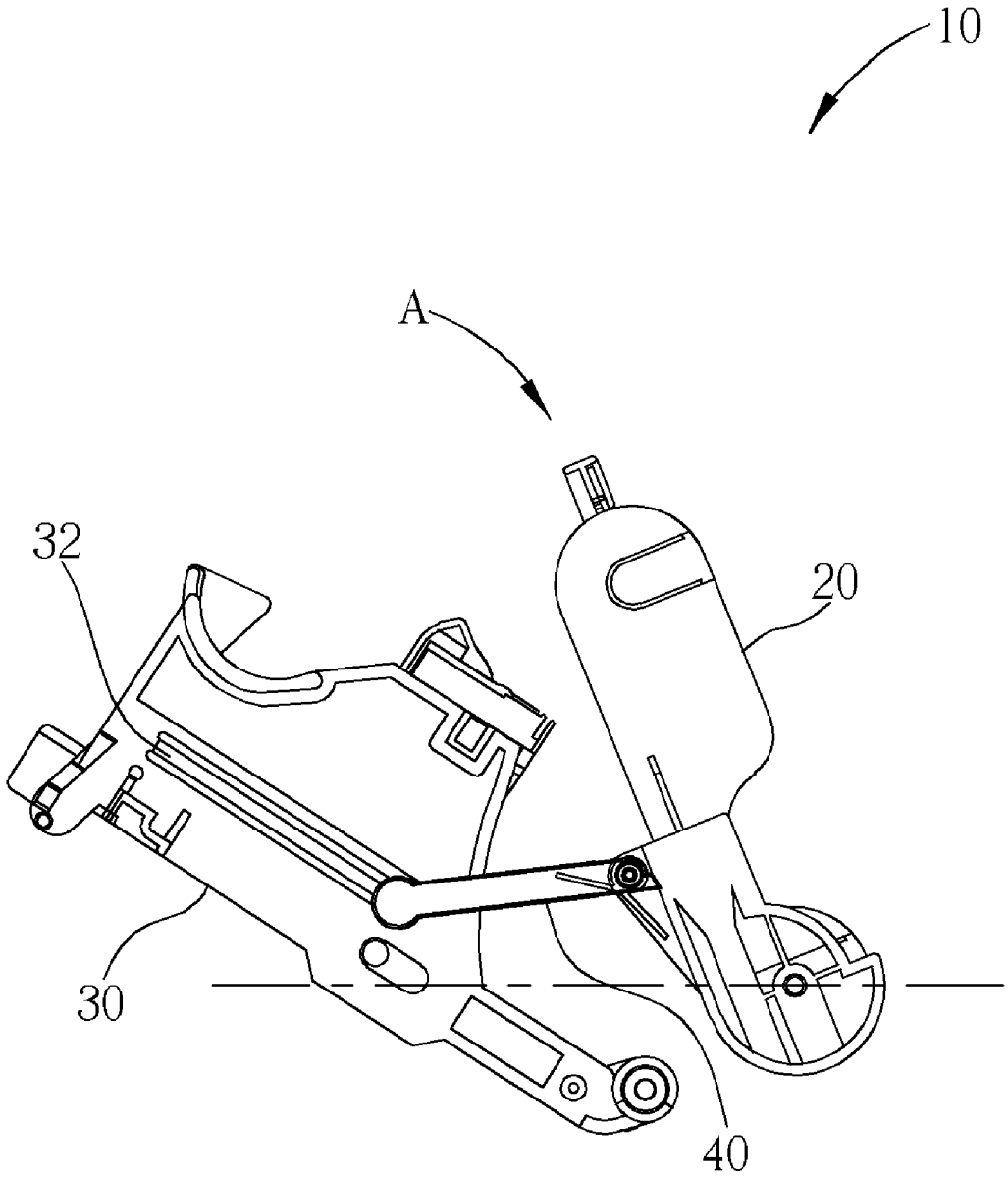
FIG. 5 is a side view of the easy-load mechanism shown in FIG. 1 in the first stage.

To better illustrate the workings of the present invention, please refer to FIGS. 5–8 in conjunction. FIG. 5 is a side view of the easy-load mechanism 10 shown in FIG. 1 in the first stage. In the first stage, the lever device 30 is located at a first initial position, and the moveable cartridge bay 20 is located at a second initial position. The linking device 40 is coupled to both the lever device 30 and the moveable cartridge bay 20 in a manner as previously described in the above. In the first stage, the easy-load mechanism 10 is able to accept a print cartridge. The print cartridge is inserted into the moveable cartridge bay 20 from above according to the direction A as shown in FIG. 5. To load the print cartridge into a dye diffusion thermal transfer printer, the user simply pushes the lever device 30 forward.

Figure 6:
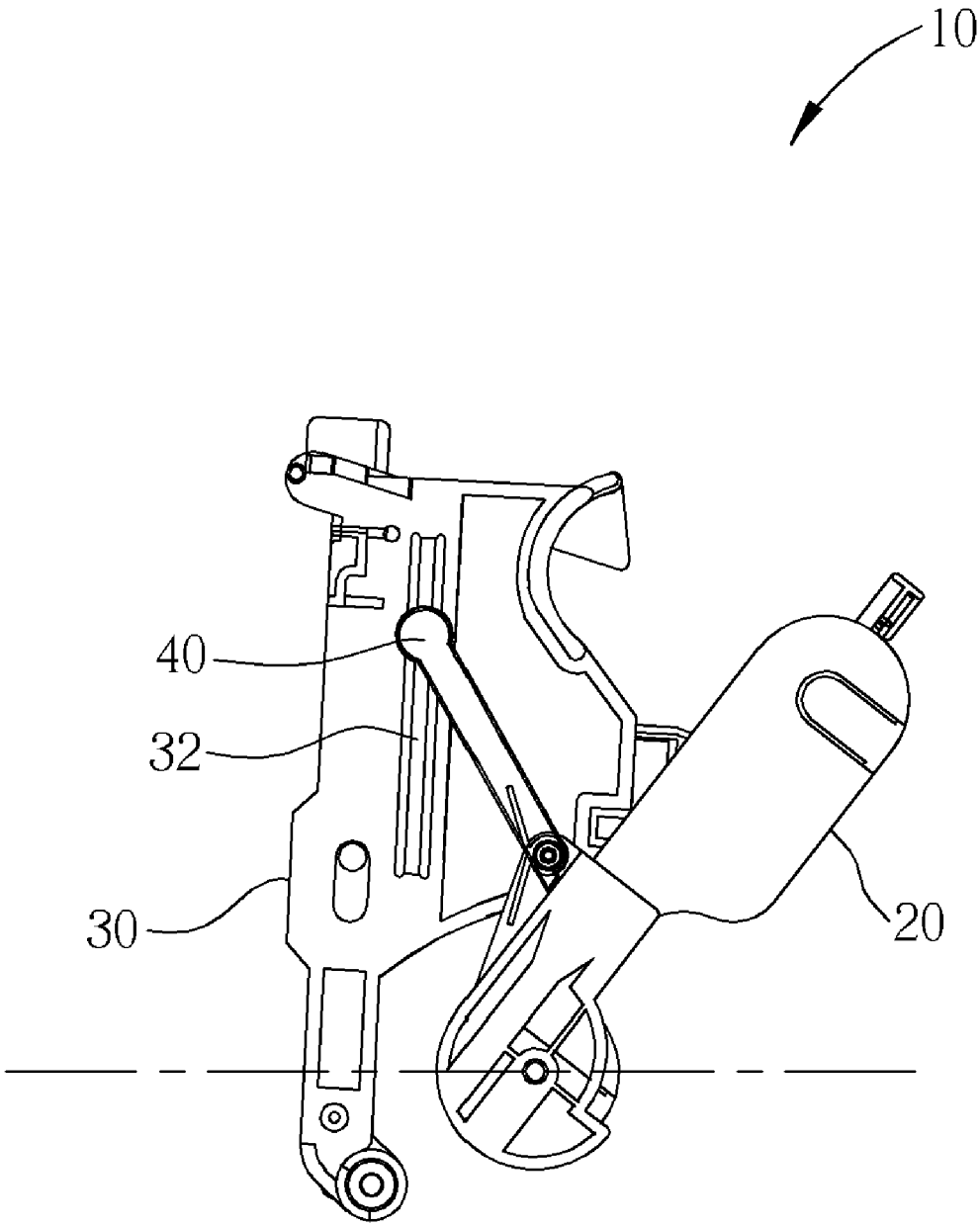
FIG. 6 is a side view of the easy-load mechanism shown in FIG. 1 in the second stage.

Please refer to FIG. 6. FIG. 6 is a side view of the easy-load mechanism 10 shown in FIG. 1 in the second stage. As depicted in FIG. 6, when the lever device 30 is pushed forward from the first initial position, the linking device 40 slides up the groove 32 of the lever device 30. As the linking device 40 slides up the groove 32, the linking device 40 also pushes against the moveable cartridge bay 20, which causes the moveable cartridge bay 20 and the inserted print cartridge to move from the second initial position.

Figure 7:
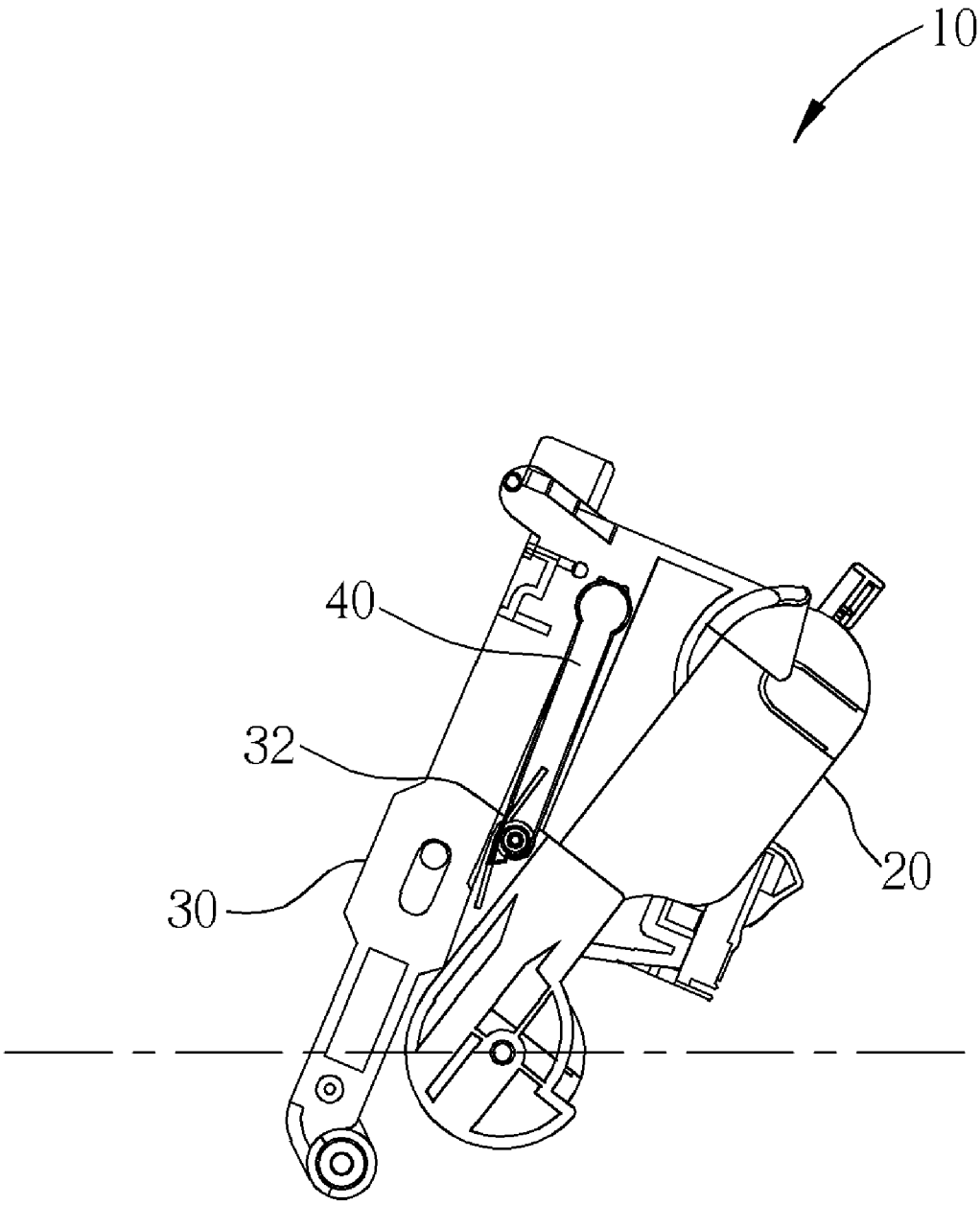
FIG. 7 is a side view of the easy-load mechanism shown in FIG. 1 in the third stage.

Please refer to FIG. 7. FIG. 7 is a side view of the easy-load mechanism 10 shown in FIG. 1 in the third stage. Eventually, the linking device 40 reaches the top of the groove 32 of the lever device 30. When this occurs, the linking device 40 no longer pushes the moveable cartridge bay 20 forward. At this point, the moveable cartridge bay 20 has reached a second target position and the lever device 30 has reached an intermediate position as depicted in FIG. 7.

Figure 8:
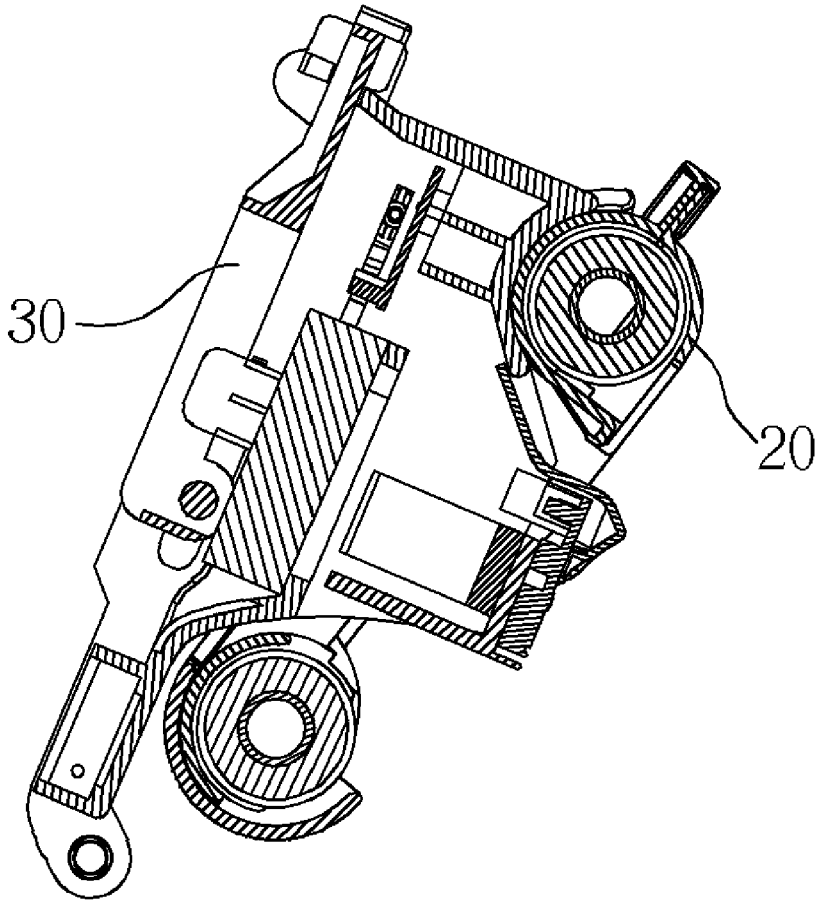
FIG. 8 is a side view of the easy-load mechanism shown in FIG. 1 in the fourth stage.

Please refer to FIG. 8. FIG. 8 is a side view of the easy-load mechanism 10 shown in FIG. 1 in the fourth stage. After the lever device 30 has reached the intermediate position, further pushing allows the lever device 30 to move forward slightly and overlay the moveable cartridge bay 20. As the lever device 30 is being pushed past the intermediate position, the spring 60 of the linking device 40 either tightens or expands according to the structure of the applied spring 60. When the lever device 30 reaches the first target position, the lever device 30 is locked in place through a lock (not shown) and the loading of the print cartridge is complete. It is well-known that the spring 60 substantially generates an elastic force to resist its deformation caused by the external force. Therefore, when the lock on the lever device 30 is released, the spring 60 of the linking device 40 unwinds, thereby pushing the lever device 30 away from the moveable cartridge bay 20. To sum up, the print cartridge is easily loaded in the printer with the help of the easy-load mechanism 10 according to the present invention.

Figure 9:
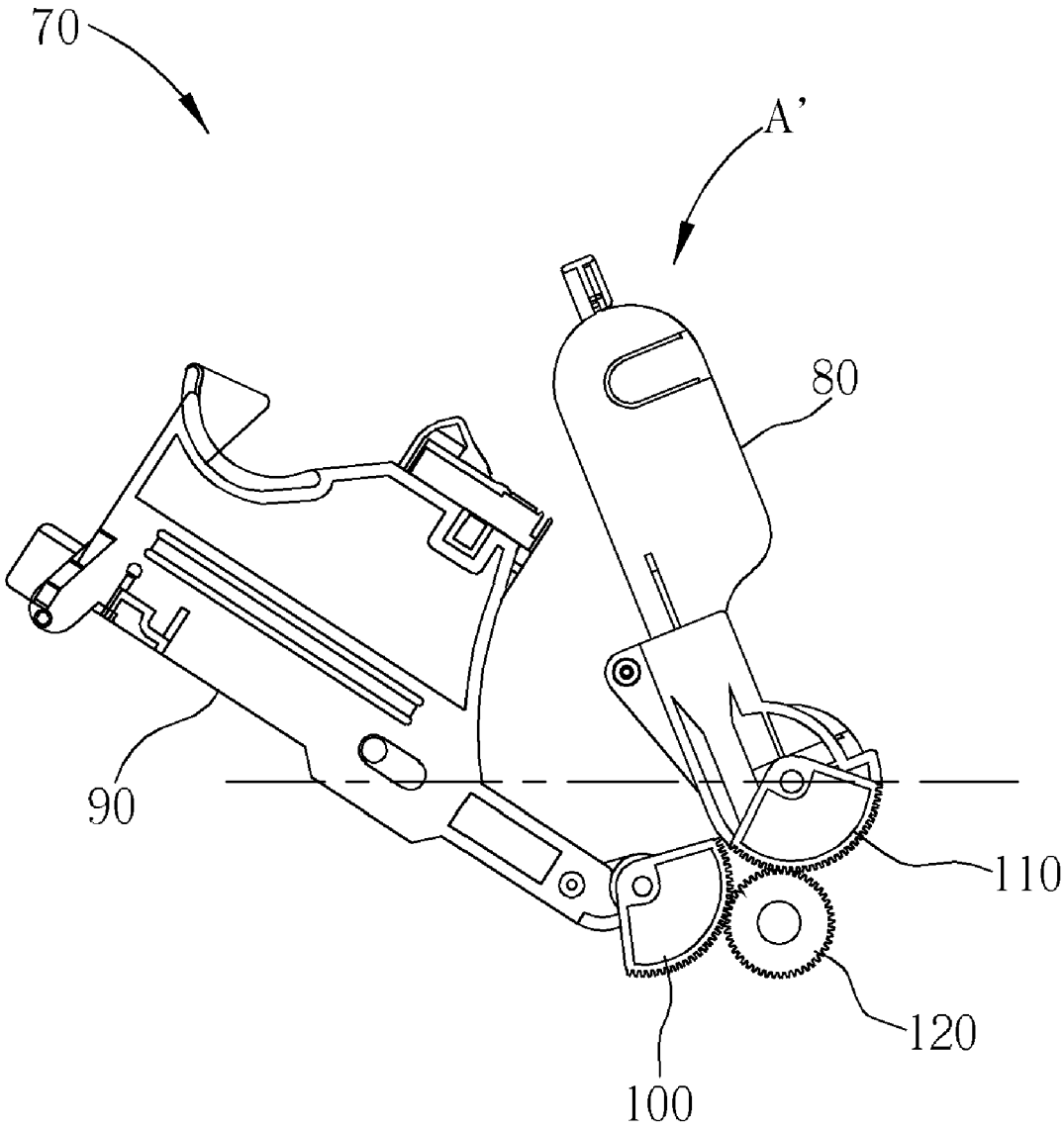
FIG. 9 is a side view of an alternative easy-load mechanism according to present invention in the first stage.
Figure 10:
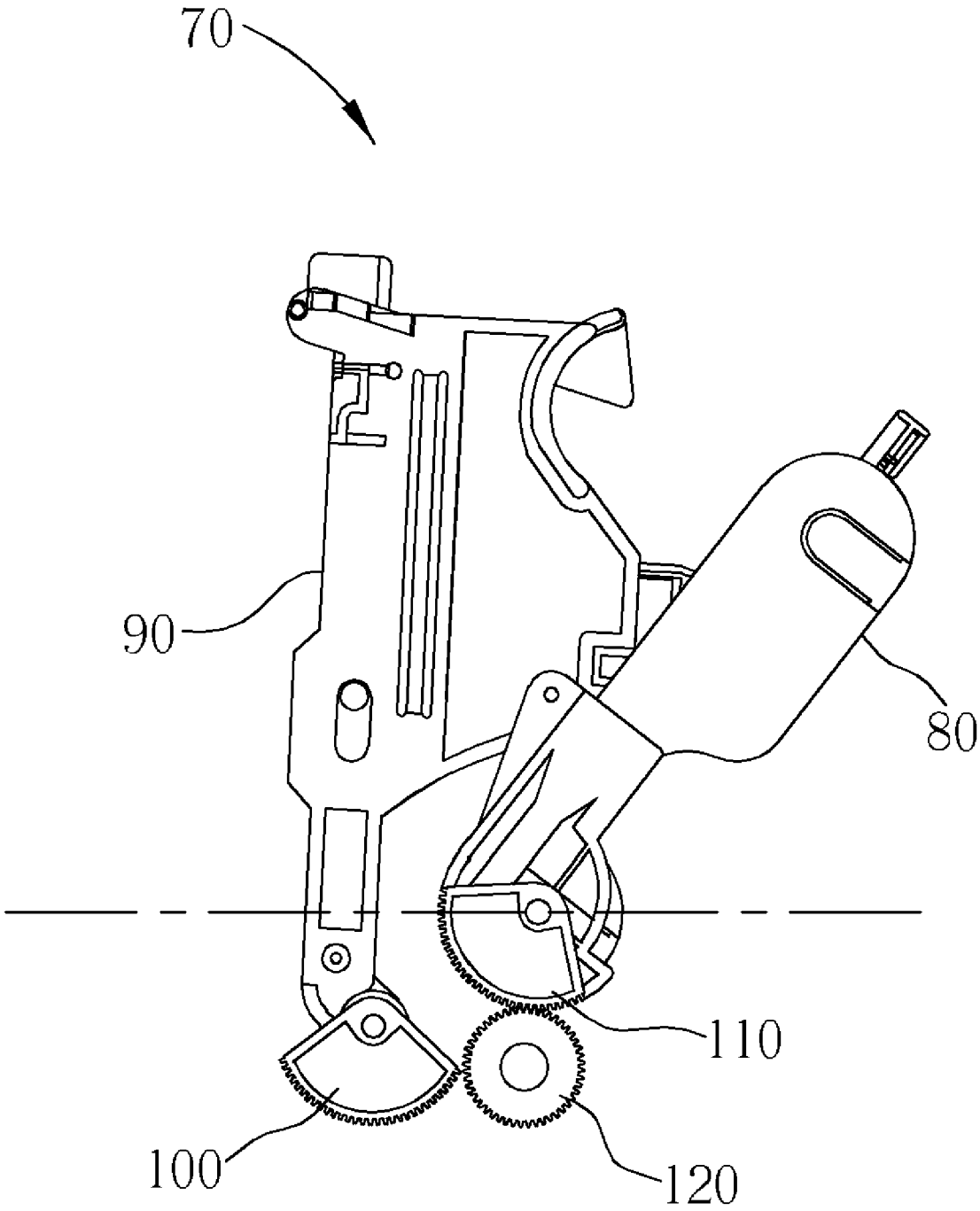
FIG. 10 is a side view of the alternative easy-load mechanism according to present invention in the second stage.

An alternative embodiment of the easy-load mechanism without the above-mentioned linking device 40 is detailed as follows. Please refer to FIG. 9. FIG. 9 is a side view of an alternative easy-load mechanism 70 according to present invention in the first stage. In this alternative embodiment, the easy-load mechanism 70 comprises a moveable cartridge bay 80, a lever device 90, a first engagement device 100 positioned on the lever device 90, a second engagement device 110 positioned on the moveable cartridge bay 80, and a third engagement device 120 positioned between the first engagement device 100 and the second engagement device 110. In this embodiment of the alternative easy-load mechanism 70, the first engagement device 100 and second engagement device 110 are represented by sector gears, and the third engagement device 120 is represented by a normal gear. This is meant only as example and should not be take as a limitation. Referring to FIG. 1, the functionality of the moveable cartridge bay 20 is the same as that of the moveable cartridge bay 80 shown in FIG. 1, and the functionality of the lever device 30 is the same as that of the lever device 90 shown in FIG. 1. Therefore, the lengthy description is skipped for simplicity.

For a clearer illustration of the operation of the alternative easy-load mechanism 70, please refer to FIGS. 9–12 in conjunction. In the first stage, the lever device 90 and the moveable cartridge bay 80 rest in a first initial position and a second initial position respectively. The first sector gear 100 and the second sector gear 110 are both engaged with the gear 120. In this first stage, the moveable cartridge bay 80 is able to accept a print cartridge inserted from above according to the direction A'.

After having inserted the print cartridge into the moveable cartridge bay 80, the user simply pushes the lever device 90 forward. As the lever device 90 is pushed forward, the first sector gear 100 is moved back. As the first sector gear 100 moves back, the first sector gear 100 causes the gear 120 to spin to the left. As the gear 120 spins, the gear 120 causes the second sector gear 110 to move to the left. The movement of the second sector gear 110 in turn makes the moveable cartridge bay 80 move forward in the same direction as the lever device 90. This can be seen in FIG. 10, which is a side view of the alternative easy-load mechanism 70 according to present invention in the second stage.

Figure 11:
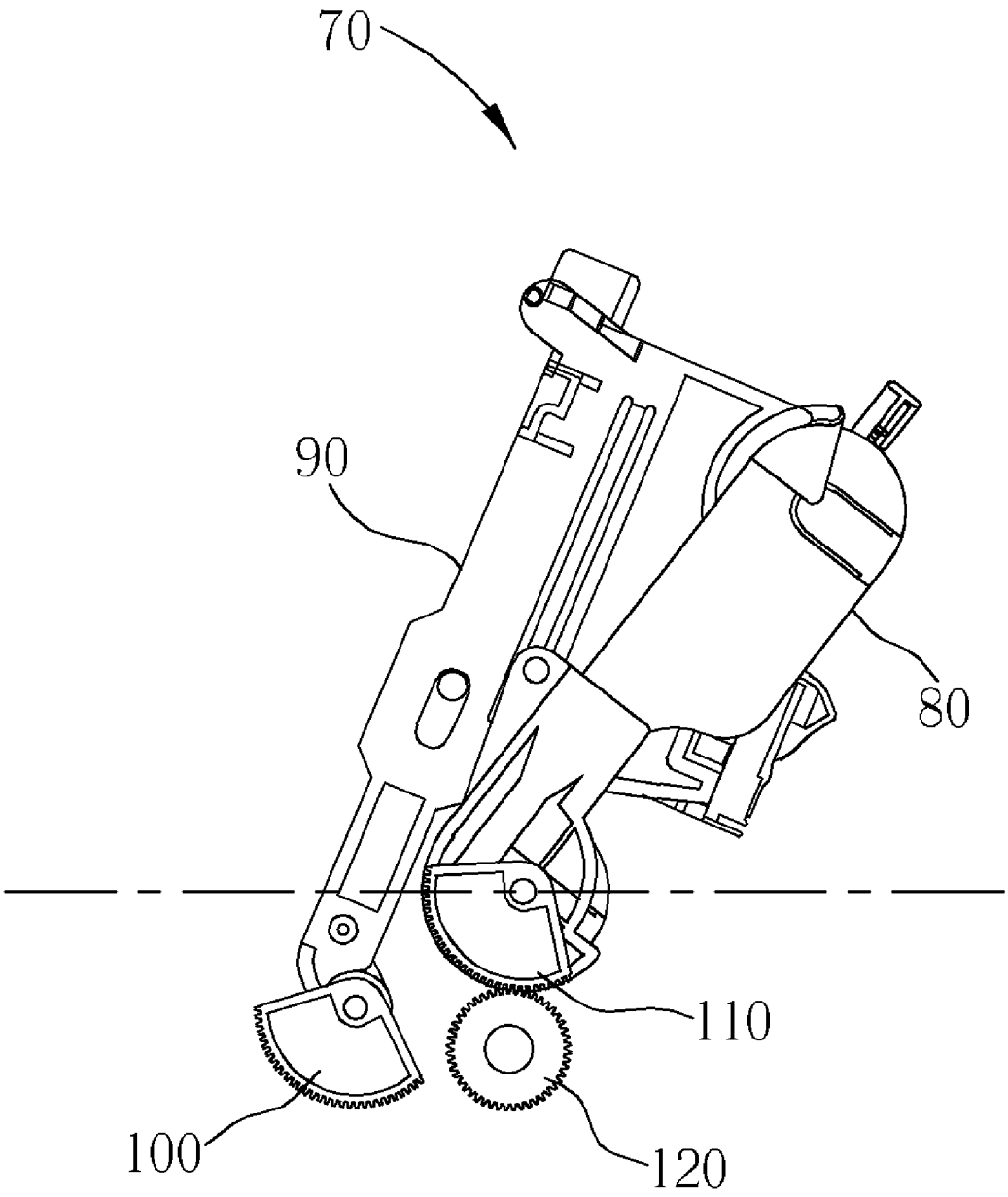
FIG. 11 is a side view of the alternative easy-load mechanism according to present invention in the third stage.

Please refer to FIG. 11. FIG. 11 is a side view of the alternative easy-load mechanism 70 according to the present invention in the third stage. After the lever device 90 has been pushed to past a certain point, the first sector gear 100 will disengage the gear 100. When the first sector gear 100 has disengaged from the gear 100, the moveable cartridge bay 80 will no longer be moved. At this point, the moveable cartridge bay 20 has reached a second target position and the lever device 30 has reached an intermediate position as depicted in FIG. 11.

Figure 12:
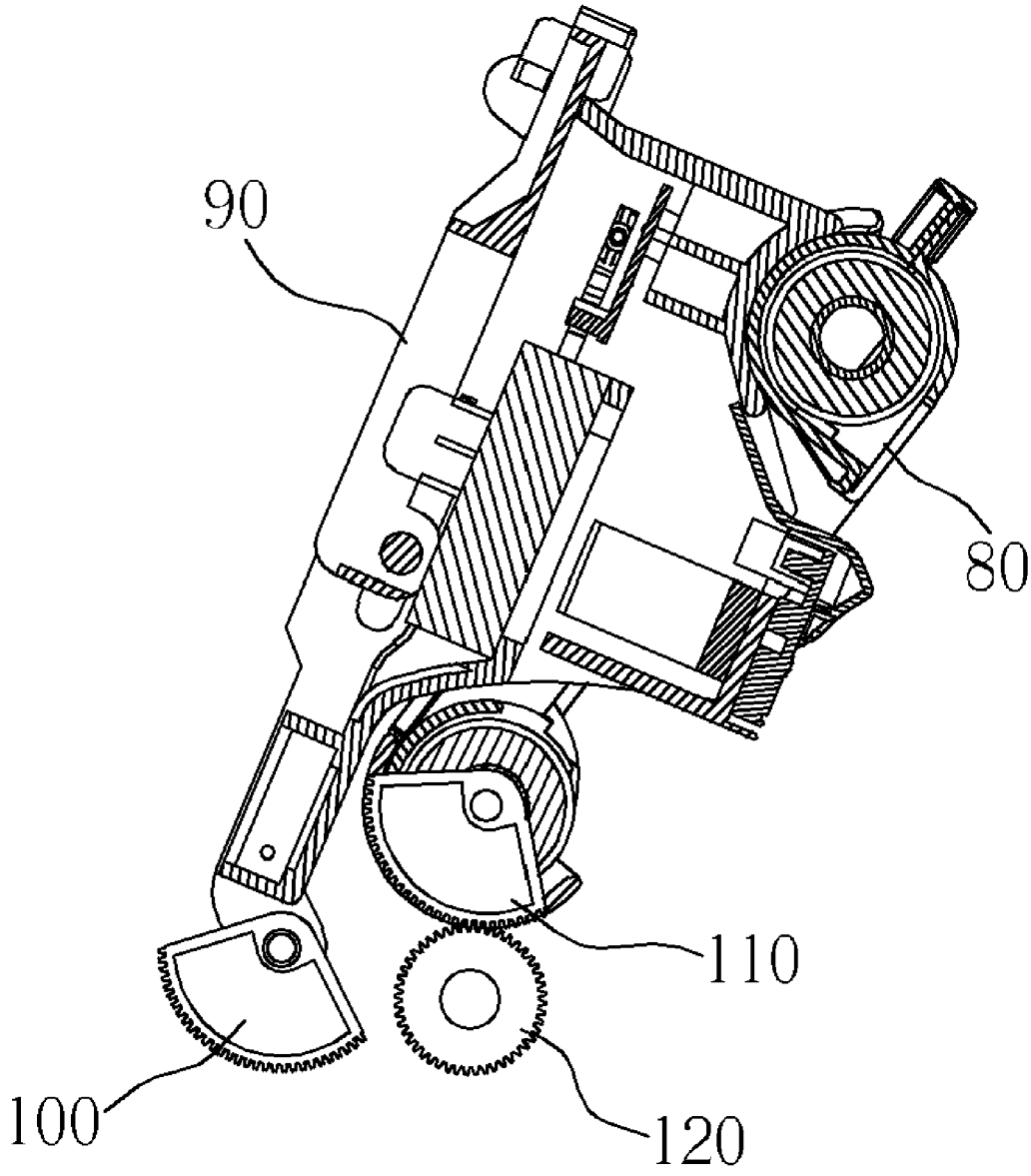
FIG. 12 is a side view of the alternative easy-load mechanism according to present invention in the fourth stage.

Please refer to FIG. 12. FIG. 12 is a side view of the alternative easy-load mechanism 70 according to the present invention in the fourth stage. After the lever device 90 has reached the intermediate position, further pushing allows the lever device 90 to move forward slightly and overlay the moveable cartridge bay 80. In this way, the print cartridge is installed in the printer.

As one can see, the present invention allows the user to install a print cartridge in an easy manner. Unlike the prior art, where the user has to install the print cartridge and manually align the print cartridge and thereby exposing one's self to being burned, the present invention allows the user to simply insert the print cartridge into the moveable cartridge bay and push the lever device forward. The position of the print cartridge is adjusted and fitted automatically and easily.

Those skilled in the art will readily observe that numerous modifications and alterations of the device may be made while retaining the teachings of the invention. Accordingly, that above disclosure should be construed as limited only by the metes and bounds of the appended claims.

What is claimed is:

1. An easy-load mechanism of a printer for installing a printer cartridge comprising:

a moveable cartridge bay for holding the printer cartridge;

a lever device coupled to the moveable cartridge bay for accepting an external force exerted upon the lever device; and a linking device coupled to the lever device and the moveable cartridge bay for transferring the external force from the lever device to the moveable cartridge bay;

wherein when the lever device is moved from a first initial position to an intermediate position, the linking device transferring the external force is capable of moving the movable cartridge bay from a second initial position to a second target position, and after the movable cartridge bay reaches the second target position, the linking device transferring the external force stops moving the movable cartridge bay, and the linking device allows the lever device to move from the intermediate position to a first target position.

2. The easy-load mechanism of claim 1 wherein the linking device comprises:

an arm unit coupled to the lever device and the moveable cartridge bay;

an elastic unit coupled to the arm unit and the moveable cartridge bay for supplying an elastic force to drive the lever device to separate from the moveable cartridge bay.

3. The easy-load mechanism of claim 2 wherein before the movable cartridge bay reaches the second target position, the lever device is capable of moving the movable cartridge bay via the arm unit.

4. The easy-load mechanism of claim 2 wherein after the movable cartridge bay reaches the second target position, the elastic unit moved by the first arm unit deforms for allowing the lever device to move from the intermediate position to the first target position.

5. The easy-load mechanism of claim 2 wherein the elastic unit is a spring.

6. The easy-load mechanism of claim 1 wherein a print head of the printer is positioned on the lever device.

7. The easy-load mechanism of claim 6 being applied to a dye diffusion thermal transfer printer.

8. The easy-load mechanism of claim 1 wherein the linking device comprises:

an arm unit coupled to the lever device and the moveable cartridge bay;

an elastic unit coupled to the arm unit and the lever device for supplying an elastic force to drive the lever device to separate from the moveable cartridge bay.

9. The easy-load mechanism of claim 1 wherein the linking device comprises:

a first arm unit coupled to the lever device;

a second arm unit coupled to the moveable cartridge bay; and an elastic unit coupled to the first arm unit and the second arm unit for supplying an elastic force to drive the lever device to separate from the moveable cartridge bay.

10. An easy-load mechanism of a printer for installing a printer cartridge comprising:

a moveable cartridge bay for holding the printer cartridge;

a lever device coupled to the moveable cartridge bay for accepting an external force exerted upon the lever device;

a first engagement device positioned on the lever device, wherein the first engagement device is moved if the lever device is moved;

a second engagement device positioned on the moveable cartridge bay; and a third engagement device positioned between the first engagement device and the second engagement device for transferring force applied to the lever device to the moveable cartridge bay;

wherein when the lever device driven by the external force is moved from a first initial position to an intermediate position, the first engagement device engages the third engagement device and the third engagement device in turn engages the second engagement device, all of which drives the second engagement device to move the movable cartridge bay from a second initial position to a second target position, and after the movable cartridge bay reaches the second target position, the first engagement device disengages from the third engagement device, thereby allowing the external force move the lever device from the intermediate position to a first target position.

11. The easy-load mechanism of claim 10 wherein the first engagement device is a first gear fixed on the lever device, the second engagement device is a second gear fixed on the movable cartridge bay, and the third engagement device is a third gear.

12. The easy-load mechanism of claim 11 wherein the first gear and the second gear are sector gears.

13. The easy-load mechanism of claim 10 wherein a print head of the printer is positioned on the lever device.

14. The easy-load mechanism of claim 13 being applied to a dye diffusion thermal transfer printer.

15. A method for installing a printer cartridge into a printer comprising:

providing a moveable cartridge bay for holding the printer cartridge;

providing a lever device for accepting an external force exerted upon the lever device;

providing a linking device for transferring the external force from the lever device to the moveable cartridge bay;

moving the lever device from a first initial position to an intermediate position through the external force and utilizing the linking device to transfer the external force for moving the movable cartridge bay from a second initial position to a second target position; and after the movable cartridge bay reaches the first target position, stopping the linking device from using the external force to move the movable cartridge bay and allowing the external force to move the lever device from the intermediate position to a first target position.

16. The method of claim 15 being applied to a dye diffusion thermal transfer printer.

17. A method for installing a printer cartridge into a printer comprising:

providing a moveable cartridge bay for holding the printer cartridge;

providing a lever device for accepting an external force exerted upon the lever device;

providing the lever device with a first engagement device which is moved if the lever device is moved;

providing the moveable cartridge bay with a second engagement device;

providing a third engagement device positioned between the first engagement device and the second engagement device for transferring force applied to the lever device to the moveable cartridge bay;

when the lever device driven by the external force is moved from a first initial position to an intermediate position, utilizing the first engagement device to engage the third engagement device to drive the second engagement device for moving the movable cartridge bay from a second initial position to a second target position; and after the movable cartridge bay is located at the second target position, disengaging the first engagement device from the third engagement device and moving the lever device driven by the external force from the intermediate position to a first target position.

18. The method of claim 17 being applied to a dye diffusion thermal transfer printer.

* * * * *